US006978997B2

(12) United States Patent
Able et al.

(10) Patent No.: US 6,978,997 B2
(45) Date of Patent: Dec. 27, 2005

(54) RECOVERY FROM DOUBLE MEDIA FEED

(75) Inventors: Douglas Anthony Able, Shelbyville, KY (US); David John Mickan, Lexington, KY (US); Mark Stephen Underwood, Lexington, KY (US); Scott Stephen Williams, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 61 days.

(21) Appl. No.: 10/720,924

(22) Filed: Nov. 24, 2003

(65) Prior Publication Data

US 2005/0179197 A1 Aug. 18, 2005

(51) Int. Cl.[7] ..... B65H 7/02
(52) U.S. Cl. ..... 271/258.01; 271/259
(58) Field of Search ..... 271/258.01, 259, 271/258.02, 258.03; 399/371, 381; 347/104, 347/153, 164, 215, 262, 264

(56) References Cited

U.S. PATENT DOCUMENTS

| | | | | |
|---|---|---|---|---|
| 5,056,771 | A | | 10/1991 | Beck et al. |
| 5,481,336 | A | | 1/1996 | Tachibana et al. |
| 5,667,215 | A | * | 9/1997 | Yoshino ..... 271/258.01 |
| 5,692,741 | A | * | 12/1997 | Nakamura et al. ..... 271/10.03 |
| 5,996,989 | A | | 12/1999 | Cahill et al. |
| 6,076,821 | A | | 6/2000 | Embry et al. |

* cited by examiner

*Primary Examiner*—David H. Bollinger
(74) *Attorney, Agent, or Firm*—John A. Brady; Grossman, Tucker, Perreault & Pfleger, PLLC

(57) ABSTRACT

Control (P) of imaging device (1) senses the period of time sensor (17) senses media (5) at input feed roller (16*a*). When a too-long-over-sensor condition is sensed, drive of input feed roller (16*a*) is terminated by operation of clutch (C). A feed roller (19*a*) farther in the media path continue to operate. One sheet of media (5) is fed while a dual fed sheet is held in the nip of feed roller (16*a*) and idle roller (16*b*). Subsequently, feed roller (16*a*) is again driven to feed the dual fed sheet for normal imaging.

10 Claims, 2 Drawing Sheets

RECOVERY FROM DOUBLE MEDIA FEED

TECHNICAL FIELD

This invention relates to feeding sheets of media in an input device in a manner which avoids feeding jams of paper or other media.

BACKGROUND OF THE INVENTION

In modern laser printers, media sheets are picked from input sources (paper trays) in a one-at-a-time fashion. The feeding of these media sheets are controlled such that there will exist a physical gap between consecutive sheets being picked. A number of sensors are provided in the paper path of the printer that allow for sensing the presence of media at particular locations.

More information about media location can be gained with a large number of sensors at a large number of locations; having fewer sensors provides cost and simplicity benefits. In practice, the number of sensors in a laser printer tends to be sensors placed only at critical locations in the paper path. Media sheets are therefore tracked through the printer by observing the transitions of these sensors with respect to time (or distance), and position is predicted based on time (or distance) when no transitions are occurring. When feeding multiple sheets of media consecutively, the existence of a physical gap between consecutive sheets is critical to the control in order for the needed sensor transitions to occur. When sensor transitions do not occur within a reasonable amount of time from when they are expected, the printer engine control will determine that a fault condition exists, such as an empty paper tray or a paper jam.

The particular type of fault condition that this invention addresses is the condition where a sensor indicates that media has been present at the sensor location for too long. Possible causes for a sensor being covered too long include: 1) A sheet over the sensor is not moving as expected (stalled, slipping, or physically jammed); 2) Paper that is longer than the expected length; 3) No gap present between two or more sheets; and 4) Overlapping/shingled sheets. In current laser printers when this sort of fault condition is detected, printing operation is stopped, a paper jam message is posted, and user intervention is required to clear media sheets from the printer.

The architecture of the particular printer for which this invention is being disclosed includes the following position sensors (in the order in which paper encounters them during printing operation): 1) A manual feed sensor, located at a point in the paper path near the manual feed slot; and 2) An input sensor, located at a point in the paper path near the imaging location. The architecture also includes a feed roll system located just beyond the manual feed sensor that is selectively driven by the primary printer drive system, through a clutch (alternately, by a separate motor).

In normal printer operation, once a sheet is picked from a paper source, the engine control tracks it through the printer. Information from the sensors and predicted sheet location information is used to determine where the sheet is located at any point in time. The primary pieces of information used to determine that paper is properly moving through the printers paper path are:

1.) The geometry of the paper path.

2.) The speed that media moves through the paper path.

3.) The locations of each of the sensors in the paper path.

4.) The instantaneous state of each of the sensors.

5.) The time that each sheet of media was picked from a media source

6.) An expected length of each sheet of media being picked.

With this information, the engine control can determine when each media sheet edge should be seen at each sensor location. Any failure of the sensor transitions to be seen within some reasonable tolerance of the predicted times indicates a fault condition.

This invention involves the fault condition when the manual feed sensor is covered for a period of time that is too long given the expected length of the media being fed. The manual feed sensor is the first sensor encountered by a sheet after it is picked. When the engine is consecutively picking media from a source, the manual feed sensor will be "made" by a sheet when the leading edge of that sheet reaches the sensor position. Similarly, the manual feed sensor will be "broken" by a sheet when the trailing edge of that sheet reaches the sensor position. If the time between the manual feed sensor "make" and "break" is more than a small amount greater than the expected time (the length of the sheet times the rate at which the sheet is intended to be moving), then a fault condition exists. In current laser printers when this sort of fault condition is detected, printing operation is stopped, a paper jam message is posted, and user intervention is required to clear media sheets from the printer.

This invention works to separate sheets to automatically recover from such a fault condition.

DISCLOSURE OF THE INVENTION

A common cause of such a fault condition in some printers is from consecutive sheets of media being fed without the necessary gap between sheets. In many cases the sheets are also overlapped to some degree when they pass this sensor location in the printer. The benefit to the user in separating the overlapped sheets will be increased reliability and decreased intervention with the printer.

In this invention, sensing the fault condition of "paper too long over manual feed sensor" is done in the same way as previous laser printers have detected "paper too long over (identified) sensor" fault conditions. However, rather than stopping the imaging device and displaying a jam message, the paper feed control mechanisms of the imaging device will attempt to separate the sheets and print them properly without intervention.

When the printer is feeding consecutive sheets and a "paper too long over manual feed sensor" condition is detected by the engine control, the engine control in one embodiment will:

1. Operate on the assumption that the fault condition is the result of no gap between the sheets being fed or overlapped sheets.
2. Wait a predictable small amount of time for the presumed trailing edge of the first sheet to pass the feed roll system that is just beyond the first sensor location.
3. Then activate the clutch which stops the feed roller system and also stops any pick actions which are taking place on the second sheet. This stops the second sheet's movement, but allows a second feed roller to continue moving the first sheet through the process.
4. Wait for the trailing edge of the first sheet to pass the next sensor in the paper path. This is determined by looking at the state of the next sensor.
5. Confirm that the first sensor is still covered by media.

6. Continue to hold the second sheet stationary some additional time while the first sheet continues to move, to assure that there is sufficient physical gap between the sheets.
7. Deactivate the clutch, which restarts the feed roller system to allow the second sheet to start moving again.
8. Optionally, confirm that the second page reaches the next sensor in the paper path, in an expected time.
9. Continue printing normally.

Through this invention, many cases of the fault condition arising from no physical gap between consecutive sheets can be automatically corrected. The proposed algorithm's effectiveness is limited by the physical locations of the feed roll and the second sensor. When the amount of overlap between the sheets is no greater than the paper path distance between the feed roller and the closer of the second sensor or the second feed roller, the proposed algorithm will allow for recovery.

Stopping of the feed system may be by a clutch when the primary purpose of the clutch is to enable the feed system to move a sheet from the manual feed to a staging position and then held stationary until picked. In such a case, a clutch as used in this invention involves no additional hardware. Use of alternative selective drives, such as separate motors, are nevertheless consistent with this invention.

DESCRIPTION OF THE DRAWINGS

The details of this invention will be described in connection with the accompanying drawings, in which.

DESCRIPTION OF THE PREFERRED EMBODIMENTS

Figure 1:
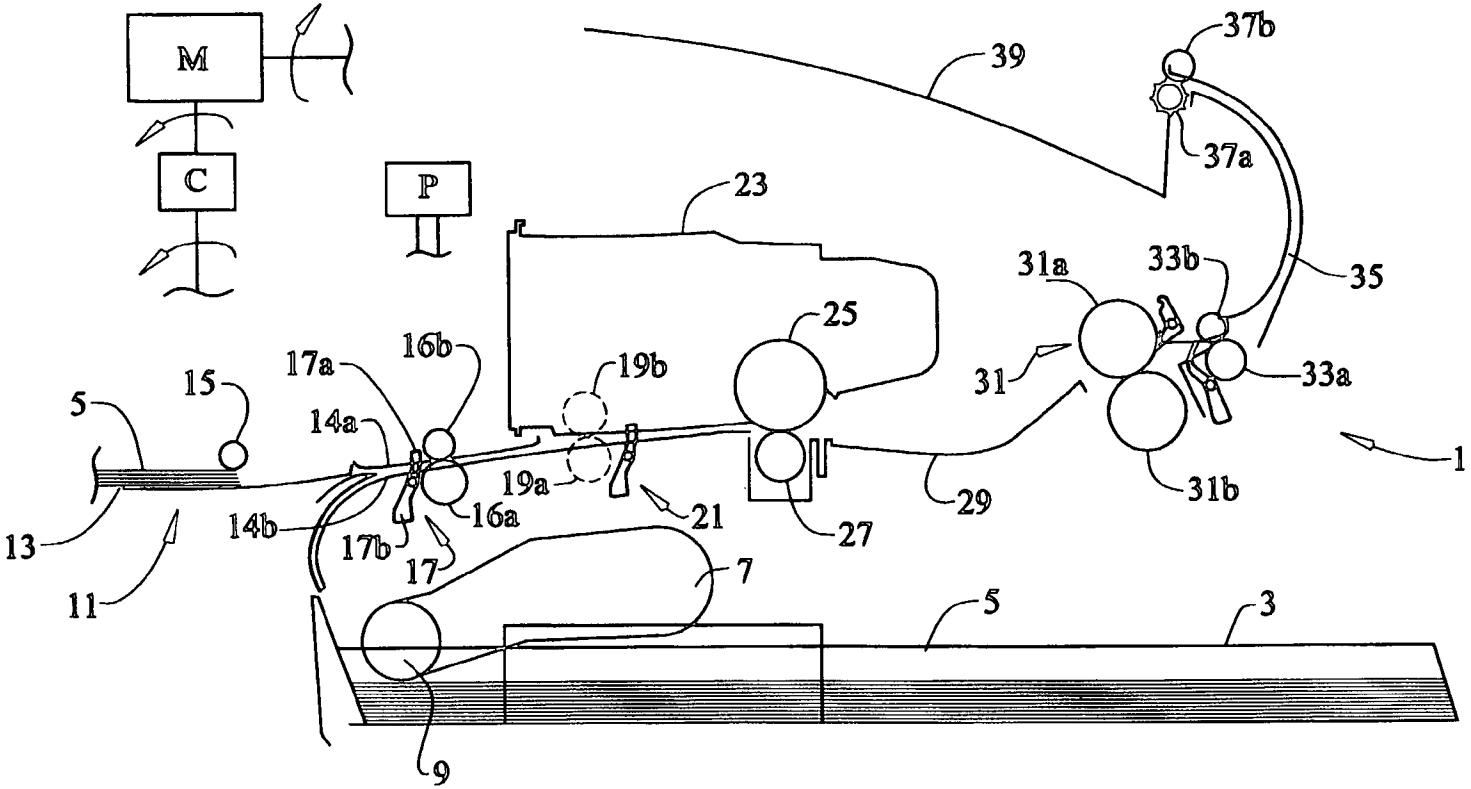
FIG. 1 is a schematic view of a typical printer employing this invention. And, FIG. 2 is a flow chart showing the operation of this invention.

As shown in FIG. 1, an imaging apparatus 1, such as a laser printer, has a paper tray 3 containing a stack of paper or other media 5.

Arm 7 pivots downward until pick roller 9 on arm 7 contacts media 5. Roller 9 is activated to feed media 5 for imaging, as is conventional.

A second source of media is external feeder 11 (often termed a manual feeder) shown illustrated as tray 13 and pick roller 15 having media 5. Such manual feeders may be sophisticated apparatus, but are known in the art, as illustrated by U.S. Pat. No. 5,996,989 to Cahill et al.

Paper or other media 5 moved through imaging device 1 is fed ideally one sheet at a time from the tray 3 by rotation of pick roller 9 or from external feeder 11 by rotation of pick roller 15. Any other structure or operation to enter media 5 into printer 1 is an alternative, as this invention is directed to separating dual-fed media 5 subsequent in printer 1.

Imaging device 1 has upper guide 14*a* and lower guide 14*b* forming a media guide path, as is standard. A drive roller 16*a* extends through lower guide 14*b* in nip engagement with idler roller 16*b*. Drive roller 16*a* is driven by motor M (shown illustratively) through a clutch C (shown illustratively). Idler roller 16*b* freely rotates as the nip with drive roller 16*a* is important to grasp media 5, while significant drag is not desirable. However, less desirable or alternative structures are possible, such as roller 16*b* being replaced by a low-friction stationary pad. Accordingly, rollers 16*a* and 16*b* are simply one embodiment of a media feed assembly.

Positioned at the location of rollers 16*a* and 16*b* in media feed path is media sensor 17. The illustrated sensor 17 is a centrally pivoted arm physically moved by the media. One end 17*a* is positioned in the media path while the opposite end 17*b* is an optical shutter sensed by a standard optical system (not shown). Any alternative which senses media presence is an alternative, such as an optical system which directs light across the media path.

It will be understood that sensor 17 can be located at a location spaced across the feed path from rollers 16*a* and 16*b*, and therefore ideally may sense exactly when media leaves rollers 16*a* and 16*b*. More generally, however, sensor 17 may sense media in or closely proximate to roller 16*a* and 16*b*.

Media 5 is fed by rollers 16*a* and 16*b* through the feed path to drive roller 19*a* and idler roller 19*b*, also having associated with them a sensor 21. The structure and operation of rollers 19*a* and 19*b* and sensor 21 is the same as that described for roller 16*a* and 16*b* and sensor 17. The location of sensor 21 is proximate to rollers 19*a* and 19*b*, which location defines generally where media 5 is entering the system which actually applies an image to media 5.

Signals from sensors 17 and sensor 21 are received by electronic data processor P (shown illustratively) which may be a standard, general purpose computer or a more special purpose computing logic such as an ASIC (application specific integrated circuit). Control of imaging devices by electronic data processing is now widely done and so will not be elaborated on.

Signals from sensors 17 and 21 identical to those employed by this invention have been employed in the past in known prior art printers to declare paper jam. Those known prior art printers did not have the clutch control C. However, such clutch control of media drive apparatus has existed in prior art imaging devices for various purposes such as for staging (moving media to intermediate positions to improve throughput) and for registration against the nip of stopped feed and idler rollers.

The remaining elements with respect to FIG. 1 will be described briefly, as they are entirely neutral to this invention. Element 23 is suggestive of a toner cartridge, which typically has as major elements toner (not shown), a developer roller (not shown), and a photoconductive drum 25. The optical system for an electrostatic image on drum 25 is largely separate from the toner cartridge and is not shown. Roller 27 is a transfer roller, which is charged to a voltage to transfer toner from drum 25 to media 5. The toned media 5 is then moved on path 29 to fuser 31, comprising heating roller 31*a* and backup roller 31*b*. Fusing fixes the toner on media 5.

Media 5 is then moved through the nip of driven roller 33*a* and idle roller 33*b* into curved path 35. Media 5 then reaches the nip of drive roller 37*a* and idler roller 37*b*, from which media 5 is ejected onto upper surface 39, where it waits until it is collected by the operator or user of printer 1.

In normal operation media 5 will be sensed as present by sensor 17 for a predetermined time with some variations because of operational tolerances. Measuring such time is a standard capability of electronic data processor P as it contains an internal oscillator or the like.

Figure 2:
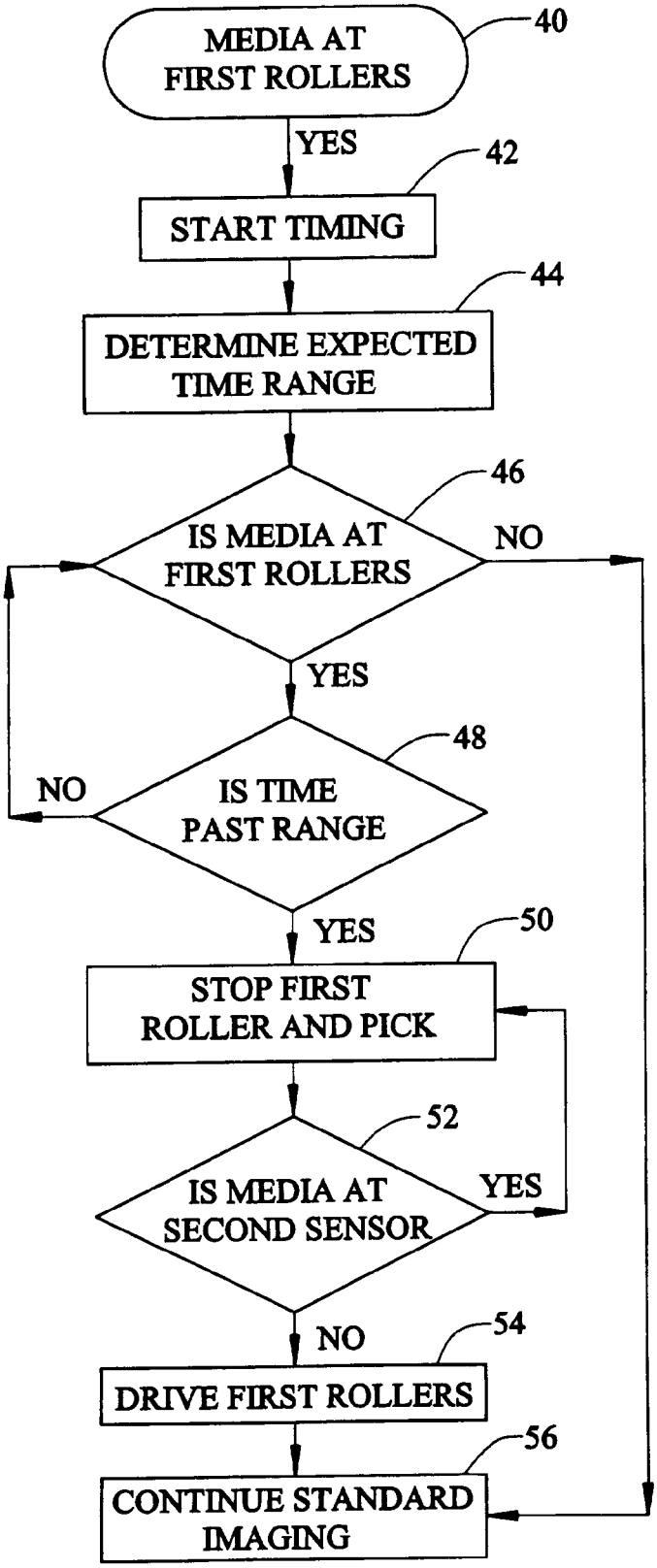

Reference to FIG. 2 illustrates the sequence of operation of this invention. The operation is started when the presence of media at the first rollers (rollers 16*a* and 16*b* in the FIG. 1 embodiment) is observed, action 40. Action 40 then initiates action 42, start timing a continuous period and action 44, determine the expected range of time for which media will be at the first roller.

Typically, the length of media is identified by the setting of the paper tray, such as tray 3 in FIG. 1. However, paper length may also be identified in other ways, such as by the heading in data defining a print job or by operator input. The actual time range is determined at manufacture or otherwise previously and stored in memory of processor P or other storage.

At periodic intervals decision 46 determines if media is still at the first rollers, if no, operation progresses directly to action 56, continue standard printing. If yes, decision 48 determines if the measured time based on action 42 is past the acceptable range.

If decision 48 is no, decision 46 is returned to at periodic intervals. If decision 48 is yes, action 50 stops the first rollers 16*a* and 16*b* and also stops pick roller 9 or 15 depending on the source. In the embodiment of FIG. 1, this is accomplished by deactivating clutch C.

Decision 52 then determines if media is at sensor 21. Sensor 21 is positioned to establish whether a sheet is being fed for normal printing. If yes, action 50 is continued so that any media at the first feed rollers does not move. If no, the first rollers are driven in action 54 and standard printing is continued in action 56. (Sensor 21 need not be near feed rollers. In the embodiment feed rollers 19*a* and 19*b* precede sensor 21 somewhat. Alternatively, feed rollers 19*a* and 19*b* could be past sensor 21. Photoconductor drum 25 a transfer roller 21 also act as feed rollers. In some designs they could be the closest rollers to sensor 21.)

Normal operation entails tracking media 5 through the printer. Accordingly, if no media 5 is observed at appropriate times after normal operation is resumed, a fault condition may be posted. Alternatively, a sheet may be fed from tray 3 or external feeder 11.

Various different sensing and feeding controls are consistent with this invention so long as the time of paper presence in the input feed apparatus can be caused to stop the feeding of a sheet still in the input feed apparatus.

What is claimed is:

1. An apparatus for separating double fed media in an imaging system which forms images on said media comprising:

a first media feeding apparatus for transporting sheets of media;

a first media sensor for detecting the presence of media;

a second media feeding apparatus for transporting sheets of media;

a second media sensor for detecting the presence of media;

an electronic data processing apparatus which receives a signal from said first and second media sensors indicating the presence of a first sheet of media and which compares the length of time that the presence of said first sheet of media is sensed by said first sensor to a predetermined time period;

a clutch in communication said electronic data processing apparatus which controls said first media feed apparatus and which is capable of terminating and restarting said feeding by said first media feeding apparatus;

wherein said electronic data processing apparatus responsive to said signal from said first media sensor is configured to (i) activate said clutch to terminate feeding in said first media feed apparatus, while said second feed apparatus continues to feed, when the length of time said first sheet of media is sensed by said first sensor exceeds said predetermined time period; and (ii) deactivate said clutch to restart feeding of media after said first sheet of media has been sensed by said second media sensor.

2. The apparatus of claim 1 wherein said first sensor is configured to detect a leading edge and trailing edge of said media.

3. The apparatus of claim 1 wherein said second sensor is configured to detect a leading edge and trailing edge of said media.

4. The apparatus of claim 1 wherein said first media feeding apparatus comprises a feed roller.

5. The apparatus of claim 1 wherein said second media feeding apparatus comprises a feed roller.

6. An apparatus for separating double fed media in an imaging system which forms images on said media comprising:

a first media feeding apparatus for transporting sheets of media;

a first media sensor for detecting the presence of media;

a second media feeding apparatus for transporting sheets of media;

a second media sensor for detecting the presence of media;

an electronic data processing apparatus which receives a signal from said first and second media sensors indicating the presence of a first sheet of media and which compares the length of time that the presence of said first sheet of media is sensed by said first sensor to a predetermined time period;

a motor in communication said electronic data processing apparatus which controls said first media feed apparatus and which is capable of terminating and restarting said feeding by said first media feeding apparatus;

wherein said electronic data processing apparatus responsive to said signal from said first media sensor is configured to (i) terminate feeding in said first media feed apparatus, while said second feed apparatus continues to feed, when the length of time said first sheet of media is sensed by said first sensor exceeds said predetermined time period; and (ii) restart feeding of media after said first sheet of media has been sensed by said second media sensor.

7. The apparatus of claim 6 wherein said first sensor is configured to detect a leading edge and trailing edge of said media.

8. The apparatus of claim 6 wherein said second sensor is configured to detect a leading edge and trailing edge of said media.

9. The apparatus of claim 6 wherein said first media feeding apparatus comprises a feed roller.

10. The apparatus of claim 6 wherein said second media feeding apparatus comprises a feed roller.

* * * * *